US005813099A

United States Patent [19]

Stewart

[11] Patent Number: 5,813,099

[45] Date of Patent: Sep. 29, 1998

[54] BURIAL CASKET WITH PHOTOGRAPHIC MEMORIAL MARKER

[76] Inventor: Glenn A. Stewart, 2308 Broadway Ave., Alexandria, La. 71301

[21] Appl. No.: 850,084

[22] Filed: May 2, 1997

[51] Int. Cl.[6] ..... A61G 17/00

[52] U.S. Cl. ..... 27/2; 40/725; 40/757

[58] Field of Search ..... 27/1, 2, 35; 40/725, 40/727, 757, 758, 792

[56] References Cited

U.S. PATENT DOCUMENTS 2,835,014 5/1958 Dioguardi, Jr. ..... 27/2

4,267,623 5/1981 Christian ..... 27/2

*Primary Examiner*—Kien T. Nguyen

*Attorney, Agent, or Firm*—Kenneth D. Baugh

[57] ABSTRACT

A burial casket 10 comprising a photographic memorial marker 30 which is coupled to the front and side walls 14 and 16. The photographic memorial marker 30 is provided with a picture 60 for identifying the deceased person in the casket 10. A support member 32 is provided for supporting the picture 60 on the front and back wall members 14 and 16. A first protective cover member 62 is aligned with and coupled to the bottom of the picture 60 on the support member 32. A second protective cover member 64 is aligned with and coupled to the top portion of the picture 60. A sealing member 66 is provided to cover the second protective cover 64 and the support member 32 so that the picture 60 is protected from moisture, and so that a harden durable surface is provided.

A plurality of coupling members 70 are provided each having an engaging arm 72 which engages selected portions of the support member 32 and coupling arms 74 which are couplable to the casket walls so that the support member is permanently coupled to the casket 10.

18 Claims, 4 Drawing Sheets

BURIAL CASKET WITH PHOTOGRAPHIC MEMORIAL MARKER

TECHNICAL FIELD

This invention relates to a photographic memorial marker and more particularly to a permanent photographic marker for identifying the remains of a person contained in a burial casket. For as long as we can remember caskets have served as a permanent storage container for the remains of the deceased. The practicality of the casket is well known. Although the casket is an accepted means for providing an efficient storage facility for the deceased there is the ongoing concern for being able to readily identify the deceased person that occupies the casket without opening the casket. A common way of identification is the head stone and other grave markers. However this method of identification has its limitations. It does not work in situations where the head stone and/or grave markers are disturbed or displaced such as, for example during natural disasters such as floods or other such disasters.

To overcome this concern a more permanent and efficient method of identifying the remains of the deceased in a casket is needed. Additionally there is a need for an identification method that allows the remains in a casket to be identified without opening the casket. Accordingly a casket having a photographic marker is needed that provides a permanent and efficient method of identifying the remains in the casket without opening the casket itself.

BACKGROUND OF THE ART

Attempts have been made to provide caskets that provide readily available identification of the deceased. One such casket is disclosed in U.S. Pat. No. 4,697,316. This burial casket is provided with a capsule which extends from a casket side wall inwardly and contains information regarding the remains contained in the casket. The capsule is removable from the casket to give access to the information without opening the casket. Another arrangement is disclosed in U.S. Pat. No. 5,007,148. The casket in this invention is one that includes a plaque which identifies the deceased that is removably mounted on a coffin by a pair of pins which includes portions disposed at an angle of about 45 Degrees to one another. An attaching means which includes a bracket secures the plaque to the remains within the coffin.

These casket arrangements are suitable for providing a means of identifying the remains in a casket. However to provide the identification one must go through the sometimes unpleasant task of opening the casket or at least somehow having access to the inside of the casket. Thus there is still a need for a casket which provides a permanent means of identifying the remains therein without having to open the casket or otherwise having to have access to the inside of the casket.

DISCLOSURE OF THE INVENTION

A casket in accordance with the principles of this invention is provided with a front wall member and a back wall member aligned with and spaced from the front wall member. The casket is also provided with a first side wall member which is aligned to engage one end of the front and back wall members and a second side wall member which is aligned to engage another end of the front and back wall members. A bottom wall member is aligned to engage bottom portions of the front, back, first and second side wall members. A first coupling means is provided to couple the front, back, side and bottom wall members together to form an enclosure having an opening formed therein for receiving the remains of the deceased. Additionally a top wall member is provided having end portions thereof aligned with and couplable to the back wall member. A second coupling means pivotally couples the portions of the top wall member hat are aligned adjacent to the back wall member to the back wall member so that the top wall member can be selectively moved to cover the opening in the enclosure. A pictorial identification member is provided which is supported adjacent an outside wall of the front wall member. A support member is provided for supporting the pictorial identification member on the outside wall of the front wall member.

The casket is also provided with a first protective cover member which is aligned with and coupled to a bottom portion of the pictorial identification member on the support member. A second protective cover member is aligned with and coupled to a top portion of the pictorial identification member. A sealing member is provided to cover the second protective cover member and the support member so that the pictorial member is protected from moisture, and so that a harden durable surface is provided. The casket is further provided with a plurality of third coupling means. Each one of the third coupling means is provided with a first portion for engaging selected portions of the support member and second portions for engaging selected portions of the front wall member so that the support member can be coupled adjacent to the front wall member to thereby permanently affix the pictorial identification member thereto.

BRIEF DESCRIPTION OF THE INVENTION

The details of the invention will be described in connection with the accompanying drawing in which.

BEST MODE FOR CARRYING OUT THE INVENTION

Figure 1:
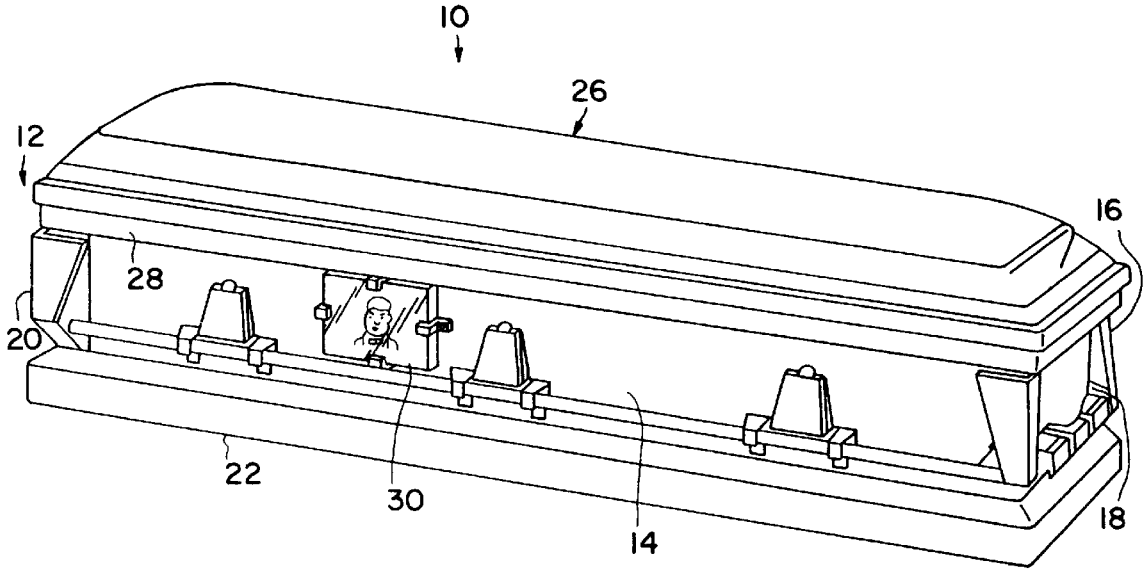
FIG. 1 is a perspective view illustrating a casket with a photographic memorial marker in accordance with the principles of this invention.
Figure 2:
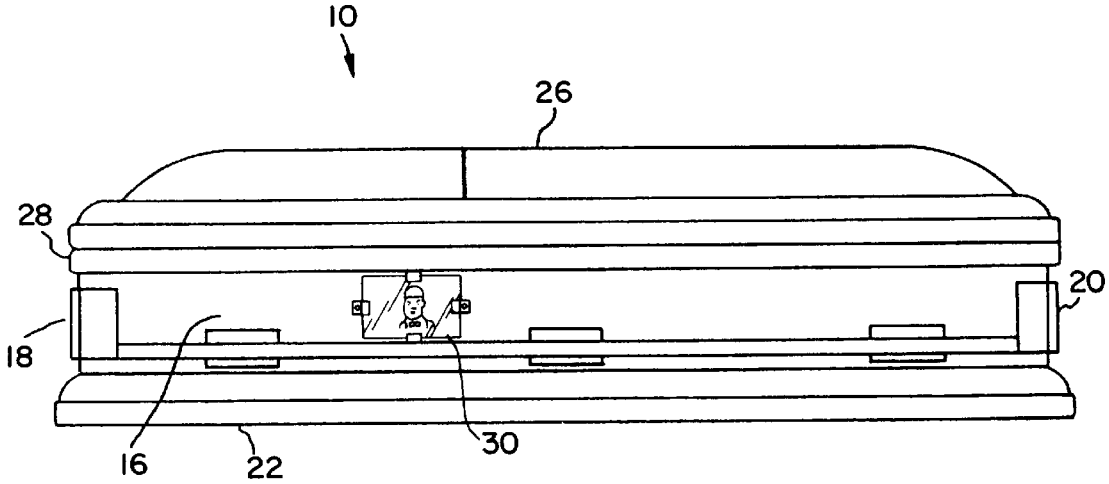
FIG. 2 is a second perspective view illustrating a casket with a photographic memorial marker in accordance with the principles of the invention.

Referring to FIGS. 1 and 2 a burial casket, generally designated by the numeral, 10, is illustrated. The burial casket 10 includes an enclosure, generally designated, by the numeral 12. The enclosure 12 is provided with front and back walls, 14 and 16, side or end walls, 18 and 20 and a bottom wall, 22. The walls 14, 16, 18, 20 and 22 are coupled together to form the enclosure 12 having an open area 24 (not shown) formed therebetween. The open area 24 is that portion of the burial casket 10 where the remains of a deceased person is placed in the casket.

The enclosure 12 is also provided with a lid or top, generally designated by the numeral, 26. The lid 26 is pivotably coupled to an upper end portion 28 of the back wall 16 of the enclosure 12 in a well known manner.

The casket 10 is also provided with a photographic memorial marker 30. The photographic memorial marker 30 provides a pictorial identification of the person whose remains are in the casket 10. The decision as to where the photographic memorial marker 30 is placed is determined in accordance with religious preference. The photographic memorial marker 30 can be secured to predetermined ones of the walls of the casket, such as, for example, the front and back walls 14 and 16 respectively.

Figure 3:
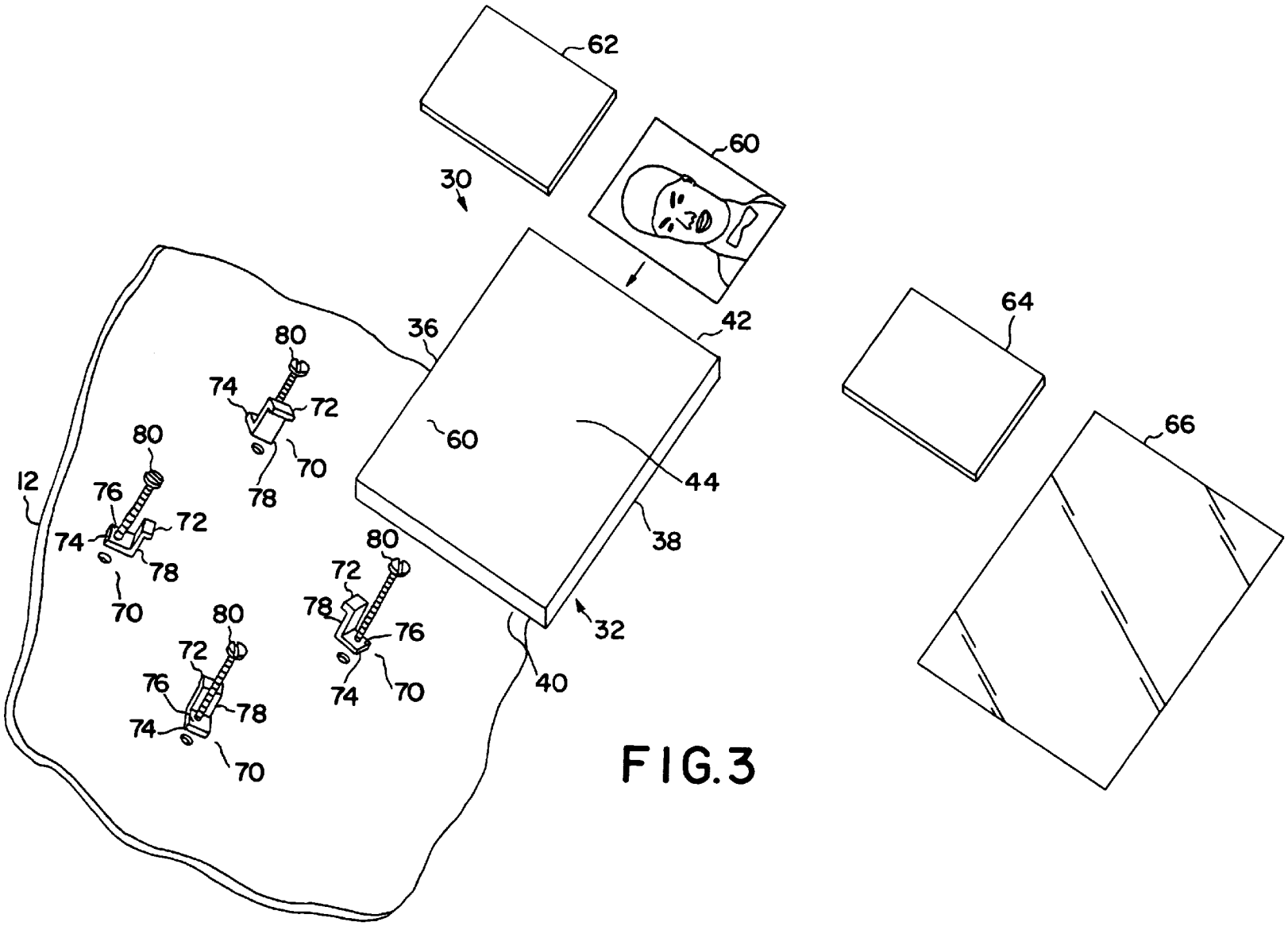
FIG. 3 is an exploded view illustrating a casket with a photographic memorial marker in accordance with the principles of this invention.
Figure 4:
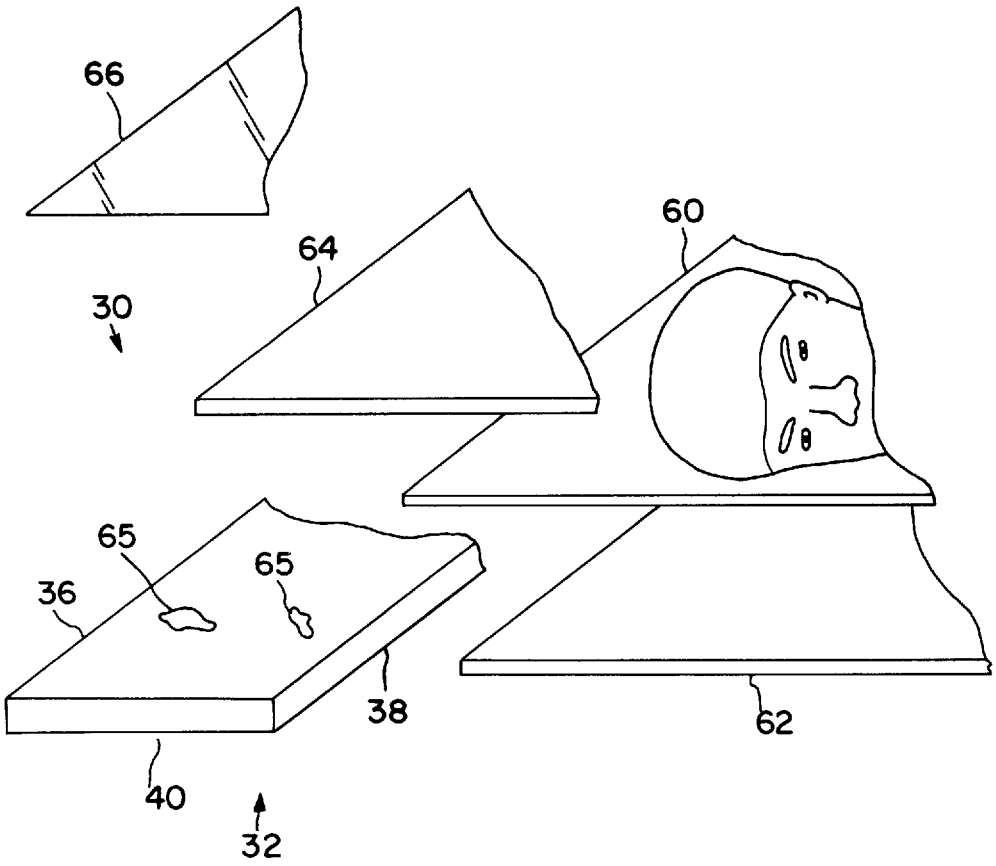
FIG. 4 is a partial exploded perspective view of a photographic memorial marker in accordance with the principles of this invention.
Figure 5:
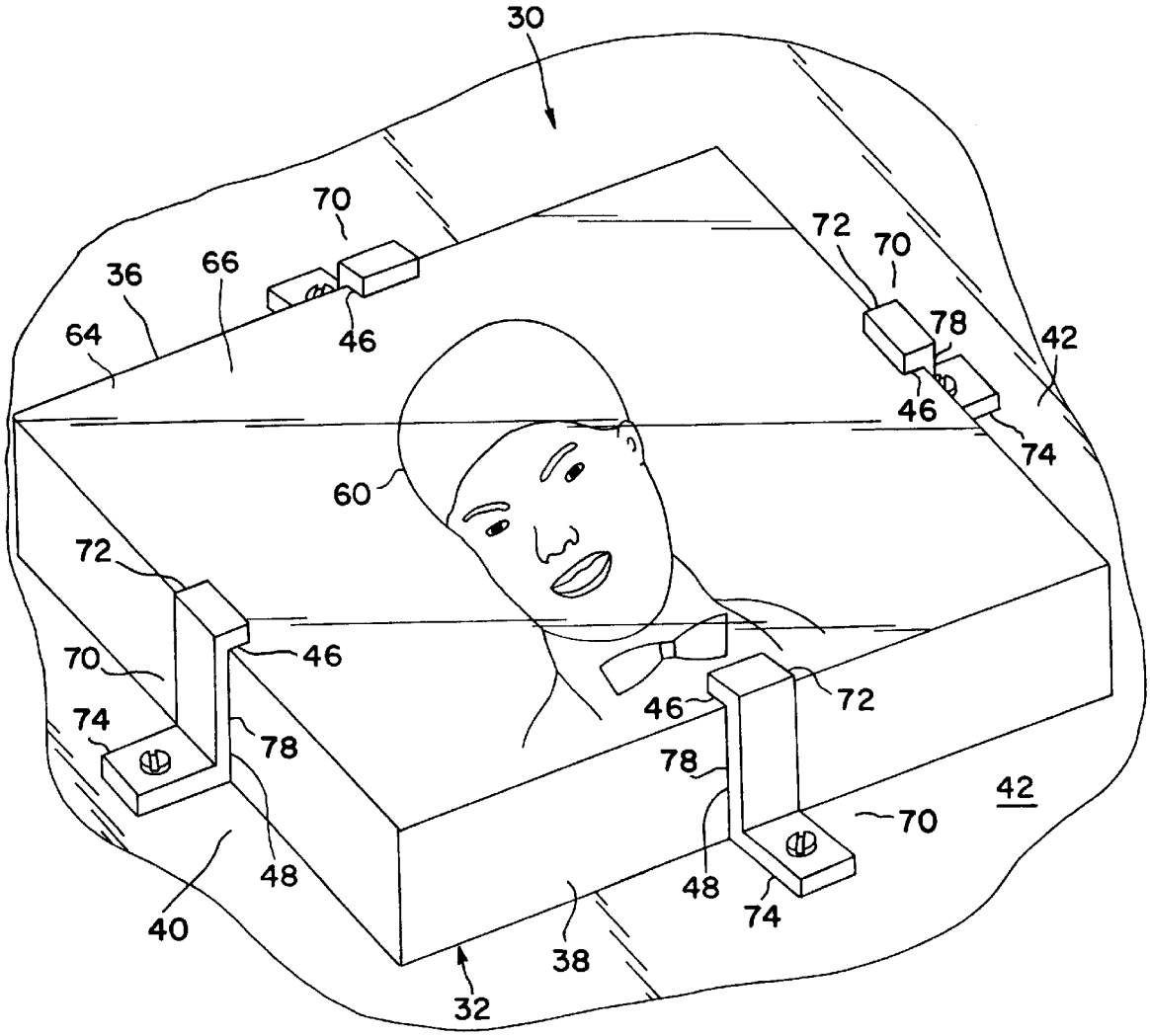
FIG. 5 is an enlarged perspective view of a photographic memorial marker coupled to the casket in accordance with the principles of this invention.

Referring to FIGS. 3, 4 and 5, the photographic memorial marker 30 is provided with a rectangular shaped base support member, generally designated by the numeral 32. The base support member 32 includes front and back walls 36 and 38 and side walls 40 and 42. The walls 36, 38, 40 and 42 are coupled together so that a planar surface 44 is formed therebetween. The base support member 32 is formed of a layer of plexiglass.

A pictorial member or picture 60, for example, a picture of a deceased person occupying the casket 10 is provided. A first protective cover 62, such as, for example, a layer of lamination, is coupled to the bottom of the picture 60. A second protective cover 64, such as, for example, a layer of lamination is coupled to the top of the picture 60. The protective covers 62 and 64 are provided to protect the picture 60 from deteriorating elements which may exist in the earth's environment. The picture 60 and protective cover 62 are supported on and coupled to the rectangular shaped support member 32 by a coupling member 65, such as, for example, an adhesive member. A sealing member 66 is provided to cover the protective cover 64 and rectangular support member 32 on the support member 32. The sealing member 66 seals the cover member 64 and support member 32 so that the picture 60 is also protected from moisture, and so that a harden durable surface is provided. The sealing member 66 has a predetermined thickness which is accomplished by applying multiple coats of the sealant and may be, for example, a sealant such as the product known by the trade name, Enviro Tex Lite.

Coupling members, generally designated by the numeral, 70 are provided for securing the base support member 32 to the casket 10. Each coupling member 70 is provided with an upper horizontally extending engaging arm 72 and a lower horizontally extending coupling arm 74 having an aperture 76 formed therein. Each coupling member 70 also includes a vertically extending intermediate arm 78 which is coupled between the upper engaging arm 72 and the lower coupling arm 74. A coupler, such as, for example a self taping screw 80 is provided to extend through the aperture 70 into an adjacent casket wall.

The base member 32 is coupled to the casket 10 (FIG. 6) by positioning coupling members 70 at predetermined selected positions on the base member. The coupling members 70 are positioned so that the upper engaging arm 72 of the coupling member engages an adjacent upper portion 46 of the walls 36, 38, 40 and 42 of the support member and so that the vertically extending intermediate arm 78 engages an outside portion 48 of the walls. This permits the lower coupling arm 72 to be coupled to an adjacent casket wall by the screw 80 thereby coupling the base member 32 to the casket.

As illustrated in FIG. 5, when the photographic memorial 30 is in place on the casket 10 the rectangular shaped base support member 32 is coupled to the casket 10 by a predetermined number of coupling members 70.

Once the photographic memorial markers 30 are mounted on the casket 10 in predetermined places a desired permanent means for identification of the deceased person occupying the casket 10 is provided without having to open the casket.

It should be understood that various changes and modifications can be made without departing from the spirit and scope of the invention as defined in the claims.

What is claimed:

1. A casket including:

a front wall member;

a back wall member aligned with and spaced from the front wall member;

a first side wall member aligned to engage one end of the front and back wall members;

a second side wall member aligned to engage another end of the front and back wall members;

a bottom wall member aligned to engage bottom portions of the front and back and first and second side wall members;

a top wall member having outermost portions thereof aligned with and coupled to the back wall member;

a first coupling means for coupling the front, back, side and bottom wall members together to form an enclosure having an opening formed therein;

a second coupling means for pivotably coupling adjacent portions of the top wall member to the back wall member so that the top wall member can be selectively moved to cover the opening in the enclosure;

a pictorial identification member supportable adjacent an outside wall of the front wall member;

a first cover member coupled to a bottom portion of the pictorial identification member for providing a protective cover for the bottom portion of the pictorial identification member;

a second cover member coupled to a top portion of the pictorial identification member for providing a protective cover for the top portion of the pictorial identification member;

a support member for supporting the pictorial identification member adjacent to the outside wall of the front wall member;

a third coupling member for coupling the pictorial identification member to the support member;

a sealing member for sealing the cover member and the support member so that the pictorial identification member is protected from moisture and so that a harden durable surface is formed; and a fourth plurality of coupling members, each coupling member having first portions which engage selected portions of the support member and second portions which engage selected portions of the wall member, for coupling the support members adjacent the front wall member.

2. A casket as defined in claim 1 wherein the support member includes a front wall, a back wall, a first side wall, and a second side wall, the front, back and side walls being coupled together so that a planar surface is formed therebetween.

3. A casket as defined in claim 2 wherein the first cover member includes a layer of lamination coupled to the bottom portion of the pictorial identification member.

4. A casket as defined in claim 3 wherein the second cover member includes a layer of lamination coupled to the top portion of the pictorial identification member.

5. A casket as defined in claim 4 wherein the pictorial identification member is supported on and coupled to the surface of the support member.

6. A casket as defined in claim 5 wherein the sealing member includes a predetermined number of layers of sealant material.

7. A casket as defined in claim 6 wherein the support member is formed of a layer of plexiglass.

8. A casket as defined in claim 7 wherein each one of the plurality of fourth coupling means includes:

an upper horizontally extending engaging arm;

a lower horizontally extending coupling arm having an aperture formed therein;

an intermediate vertically extending arm coupled between the upper engaging arm and the lower coupling arm; and a coupling member aligned to extend through the aperture in the lower coupling arm so that when the upper engaging arm is aligned to couplingly engage an upper portion of the wall of the support member and the lower coupling arm is aligned to engage the casket wall, the coupling member can be coupled to the casket wall thereby coupling the support member to the casket wall.

9. A casket as defined in claim 8 further including:

a second pictorial identification member supportable adjacent an outside wall of the back wall member;

a third cover member coupled to a bottom portion of the second pictorial identification member for providing a protective cover for the bottom portion of the second pictorial identification member;

a fourth cover member coupled to a top portion of the second pictorial identification member for providing a protective cover for the top portion of the second pictorial identification member;

a second support member for supporting the second pictorial identification member adjacent the outside wall of the back wall member;

a fifth coupling member for coupling the pictorial member to the support member;

a second sealing member for sealing the third cover member and the second support member so that the pictorial identification member is protected from moisture and so that a hard durable surface is formed; and a sixth plurality of coupling members, each coupling member having first portions which engage selected portions of the support member and second portions which engage selected portions of the wall members for coupling the support member adjacent the back wall member.

10. A photographic memorial marker for a burial casket including:

a pictorial identification member;

a first cover member coupled to a bottom portion of the pictorial identification member for providing a protective cover for the bottom portion of the pictorial member;

a second cover member coupled to a top portion of the pictorial member for providing a protective cover for the top portion of the pictorial identification member;

a support member for supporting the pictorial identification member adjacent to an outside wall of the casket;

a first coupling means for coupling the pictorial identification member to the support member;

a sealing member for sealing the second cover member and the support member so that the pictorial member is protected from moisture and so that a hard durable surface is formed; and a second plurality of coupling means having first portions which engage selected portions of the support member and second portions which adapted to engage selected portions of the outside wall of the casket for coupling the support member to the casket.

11. A photographic memorial marker as defined in claim 10 wherein the support member includes a front wall, a back wall, a first side wall, and a second side wall, the front, back and side walls being coupled together so that a planar surface is formed therebetween.

12. A photographic memorial marker as defined in claim 11 wherein the first cover member includes a layer of lamination coupled to the bottom portion of the pictorial identification member.

13. A photographic memorial marker as defined in claim 12 wherein the second cover member includes a layer of lamination coupled to the top portion of the pictorial identification member.

14. A photographic memorial marker as defined in claim 13 wherein the pictorial identification member is supported on and coupled to the planar surface of the support member.

15. A photographic memorial marker as defined in claim 14 wherein the third coupling member is a layer of adhesive.

16. A photographic memorial marker as defined in claim 15 wherein the sealing member includes a predetermined number of layers of sealant material.

17. A photographic memorial marker as defined in claim 16 wherein the support member is formed of a layer of plexiglass.

18. A photographic memorial marker as defined in claim 17 wherein each one of the plurality of second coupling means include:

an upper horizontally extending engaging arm;

a lower horizontally extending coupling arm having an aperture formed therein;

an intermediate vertically extending arm coupled between the upper engaging arm and the lower coupling arm; and a coupling member aligned to extend through the aperture in the lower coupling arm so that when the upper engaging arm is aligned to couplingly engage an upper portion of the wall of the support member and the lower coupling arm is aligned to engage the casket wall, the coupling member can be coupled to the casket wall thereby coupling the support member to the casket wall.

* * * * *